US007350492B2

(12) United States Patent
Barth et al.

(10) Patent No.: US 7,350,492 B2
(45) Date of Patent: Apr. 1, 2008

(54) GUIDE GIB FOR THE VALVE OPERATING MECHANISM OF AN INTERNAL COMBUSTION ENGINE

(75) Inventors: Christian Barth, Herzogenaurach (DE); Henning Karbstein, Adelsdorf (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/422,931

(22) Filed: Jun. 8, 2006

(65) Prior Publication Data

US 2006/0278184 A1 Dec. 14, 2006

(30) Foreign Application Priority Data

Jun. 9, 2005 (DE) ..... 10 2005 026 504

(51) Int. Cl.
*F01L 1/14* (2006.01)

(52) U.S. Cl. ..... 123/90.5; 123/90.48; 123/90.52; 123/90.55

(58) Field of Classification Search ..... 123/90.5
See application file for complete search history.

(56) References Cited

U.S. PATENT DOCUMENTS 5,088,455 A * 2/1992 Moretz ..... 123/90.5
6,257,189 B1 7/2001 Moretz et al.
6,978,752 B2 * 12/2005 Albertson et al. ..... 123/90.5
6,994,064 B2 * 2/2006 Haas et al. ..... 123/90.5
2006/0169227 A1 * 8/2006 Keller et al. ..... 123/90.5

FOREIGN PATENT DOCUMENTS

DE 41 17 425 Y 7/1992
DE 41 15 670 Y 11/1992
DE 44 35 400 Y 4/1996

* cited by examiner

*Primary Examiner*—Thomas Denion
*Assistant Examiner*—Kyle M. Riddle
(74) *Attorney, Agent, or Firm*—Lucas & Mercanti, LLP

(57) ABSTRACT

In a guide gib for the valve operating mechanism of an internal combustion engine, having holding spaces (12, 13), which are arranged in the gib (8) at intervals one behind the other, for valve tappets, wherein to prevent a valve tappet from rotating about its central longitudinal axis in each case, flattened portions (14, 15) are formed within the associated holding space (12, 13) of the guide gib (8), it being possible for flattened portions of the valve tappet to bear against said flattened portions (14, 15), according to the invention, the guide gib (8) is formed by a plastic support (9) and a plurality of inlay parts (10, 11) which are provided with the holding spaces (12, 13), each of said inlay parts (10, 11) being made of a higher-strength material than the material of the plastic support (9) and being inserted into the plastic support (9).

4 Claims, 2 Drawing Sheets

GUIDE GIB FOR THE VALVE OPERATING MECHANISM OF AN INTERNAL COMBUSTION ENGINE

FIELD OF THE INVENTION

The invention relates to a guide gib for the valve operating mechanism of an internal combustion engine, having holding spaces, which are arranged in the gib at intervals one behind the other, for valve tappets, wherein to prevent a valve tappet from rotating about its central longitudinal axis in each case, flattened portions are formed within the associated holding space of the guide gib, it being possible for flattened portions of the valve tappet to bear against said flattened portions.

BACKGROUND OF THE INVENTION

A guide gib or holding device for valve tappets or cam followers is used in valve operating mechanisms of internal combustion engines as an assembly, rotation-preventing and orientation means. So-called plastic lifter guides are already known, in which, however, the required alignment torques necessitate large contact faces of the flattened portions. To increase functional reliability, the connections of the valve tappets to the lifter guides are usually designed as press fits. Considerable frictional forces therefore occur during operation. In certain embodiments of guide gibs, said frictional forces require the spring forces of the valve tappets to be increased to a high level. Said increase is however opposed by the small available installation spaces of the tappets. On the other hand, certain minimum sizes of the contact faces are necessary for the functional reliability of such a guide gib. One significant advantage of said solution is the possibility of freely shaping the plastic, for example by means of an injection-moulding process. In addition, the "soft" plastic permits significant distortion as a result of production-related positional tolerances, without causing large forces and stresses within the component and in the contacting regions.

The document DE 102 12 522 A1 also mentions that, in internal combustion engines, it is known to prevent a roller tappet from rotating by using a plastic bridge, in which the tappet is held by a real guidance. Here, at least one planar face section is formed on the casing of the cylindrical tappet, said planar face section interacting with a corresponding planar surface section of a holding space of the holding device. To simplify transport and assembly of the valve operating mechanism parts, the tappets are pre-assembled on the holding device with contact pressure at the mutually contacting faces.

The document U.S. Pat. No. 5,088,455 A presents a holding device in which the necessary clamping of the tappet for assembly also remains effective during later engine operation, when only the rotation-preventing function is required. Said document describes an assembly aid or holding device which is injection-moulded from plastic with corresponding glass fibre reinforcement. Said assembly aid or holding device is however only designed for standard roller tappets, that is to say the positioning and the correct location of the tappet are of secondary importance here.

The document DE 197 12 610 A1 explains that internal combustion engines conventionally have roller tappets which engage with cam lobes of a camshaft. Since the tappets cannot rotate about their longitudinal axis because the rollers on the tappets must remain in the same plane as the cam lobes, the tappets are suitably aligned in the cylinder block of the internal combustion engine using holding devices, said tappets being prevented from rotating.

So-called metal lifter guides are also already known, in which, however, positional tolerances and production tolerances have an unfavourable effect because of the greater stiffness in relation to plastic. In addition, a solution in which there is rotational play can also give rise to functional concerns; the greater the play, the greater the negative functional influences. A significant advantage of said solution is the high degree of security against wear of the active faces. With current heat treatment processes, it is possible in such metal components to obtain surface strengths which permit high contact stresses. This facilitates, in conjunction with the high modulus of elasticity of the material of the guide gib, "play guides" for preventing rotation, with simultaneously small active faces.

A guide gib of the type mentioned in the introduction is known from DE 101 63 411 A1. Said guide gib can consist entirely either of a plastic or of a metallic material.

SUMMARY OF THE INVENTION

The invention is based on the object of specifying a highly functionally reliable design for a guide gib.

Said object is achieved according to the invention in that the guide gib is formed by a plastic support and a plurality of inlay parts which are provided with the holding spaces, each of said inlay parts being made of a higher-strength material than the material of the plastic support and being inserted into the plastic support. Here, the inlay parts can be produced from a metallic material.

This results in a combined solution which avoids the disadvantages and combines together the advantages of the two known solutions, specifically the guide gib which consists entirely of plastic and the guide gib which consists entirely of a higher-strength material than plastic. The inlay part can have very tight tolerances with respect to the guided cam follower or valve tappet since position-dependent tolerances are compensated by the flexible plastic which surrounds the inlay part with the tappet. The absolute variation in play is only determined by the inlay part and the cam follower, so that a very narrow basic tolerance is thus permitted. This reduces the loading of the guide gib, with simultaneously high wear resistance. Positional tolerances of the engine block of the internal combustion engine, which are conventionally relatively large, are compensated by the flexibility of the plastic support of the guide gib. As a result of the mutually contacting faces of, respectively, the inlay part and the associated valve tappet, for example metal on metal, the resulting frictional forces are low. The additional force requirements of return springs which may be integrated in the cam follower are also reduced as a result.

BRIEF DESCRIPTION OF THE DRAWING

One exemplary embodiment of the invention is illustrated in the drawing and is described in more detail in the following in comparison with previously known guide gibs which are likewise illustrated. In the drawing.

DETAILED DESCRIPTION OF THE DRAWINGS

Figure 4:
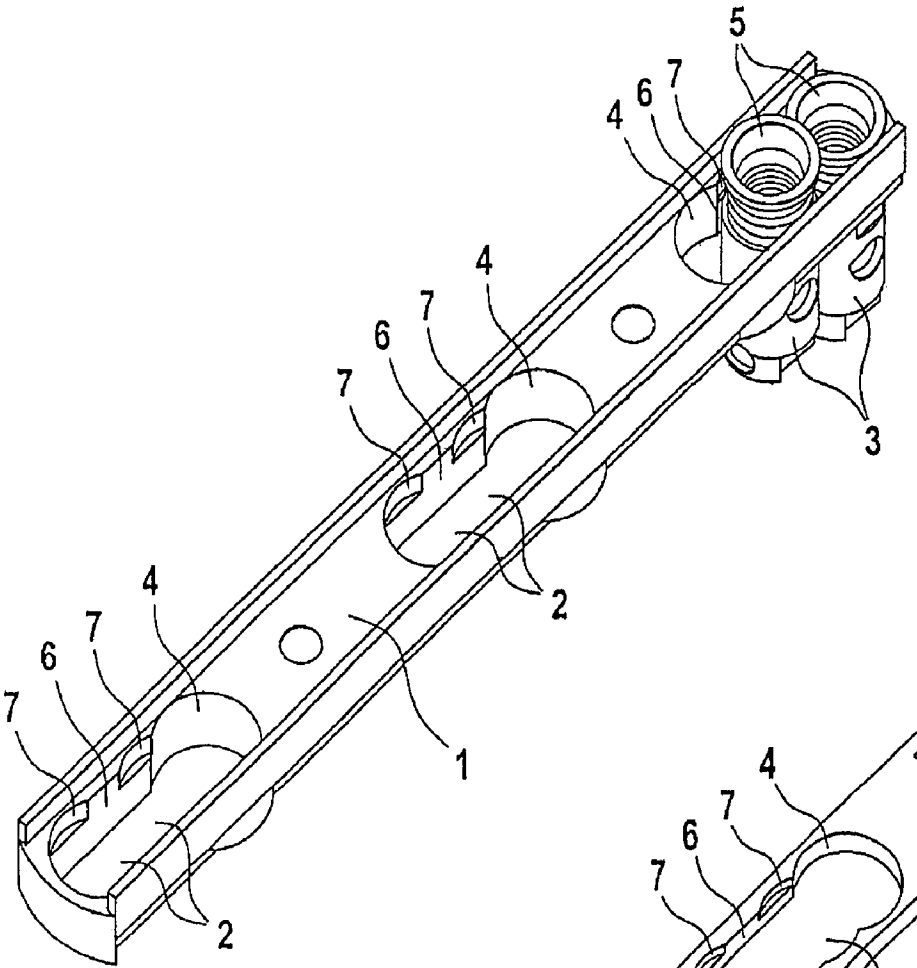
Fig. 4 PRIOR ART
FIG. 4 shows a perspective view of a guide gib according to the previously known prior art consisting entirely of plastic.

A previously known guide gib 1 which is illustrated in FIG. 4 has a plurality of holding spaces 2, arranged at intervals one behind the other, for valve tappets 3. Two holding spaces 2 are in each case arranged in a pair and are connected to an insertion bore 4, through which a valve tappet 3 which is provided with a trumpet-shaped end 5 can be inserted. The valve tappet 3 is provided with flattened portions on its casing. Said flattened portions interact with flattened portions 6 of the guide gib 1, which are arranged within the holding spaces 2, when the valve tappet 3, which is inserted into the insertion bore 4, is pushed from there into one of the two holding spaces 2 which are arranged in a pair. During said movement, the longitudinal axis of the valve tappet 3 is displaced in a parallel fashion. The flattened portions of the valve tappet 3 and the flattened portions 6 of the guide gib 1 now rest against one another, so that it is not possible for the valve tappet 3, which is held by the guide gib 1, to rotate about its longitudinal axis.

After being displaced out of the insertion bore 4 into the holding space 2, the valve tappet 3 is pulled downwards in the direction of its longitudinal axis, that is to say in the direction of the associated piston of the internal combustion engine. In the process, the trumpet-shaped end 5 of the valve tappet 3 passes into circular-segment-shaped cut-outs 7 of the guide gib 1, said cut-outs 7 being associated with the holding spaces 2. This prevents the valve tappet 3 from moving back into the insertion bore 4. When the guide gib 1 is fully equipped with valve tappets 3 in this way, it can be mounted onto the internal combustion engine.

The thickness of the guide gib can vary as a function of the cam stroke and the height of the rotation-preventing faces of the internal combustion engine. The material used also determines the design and the height of the guide gib. In the embodiment illustrated in FIG. 4, a fibre-reinforced plastic is used for the guide gib 1.

Figure 5:
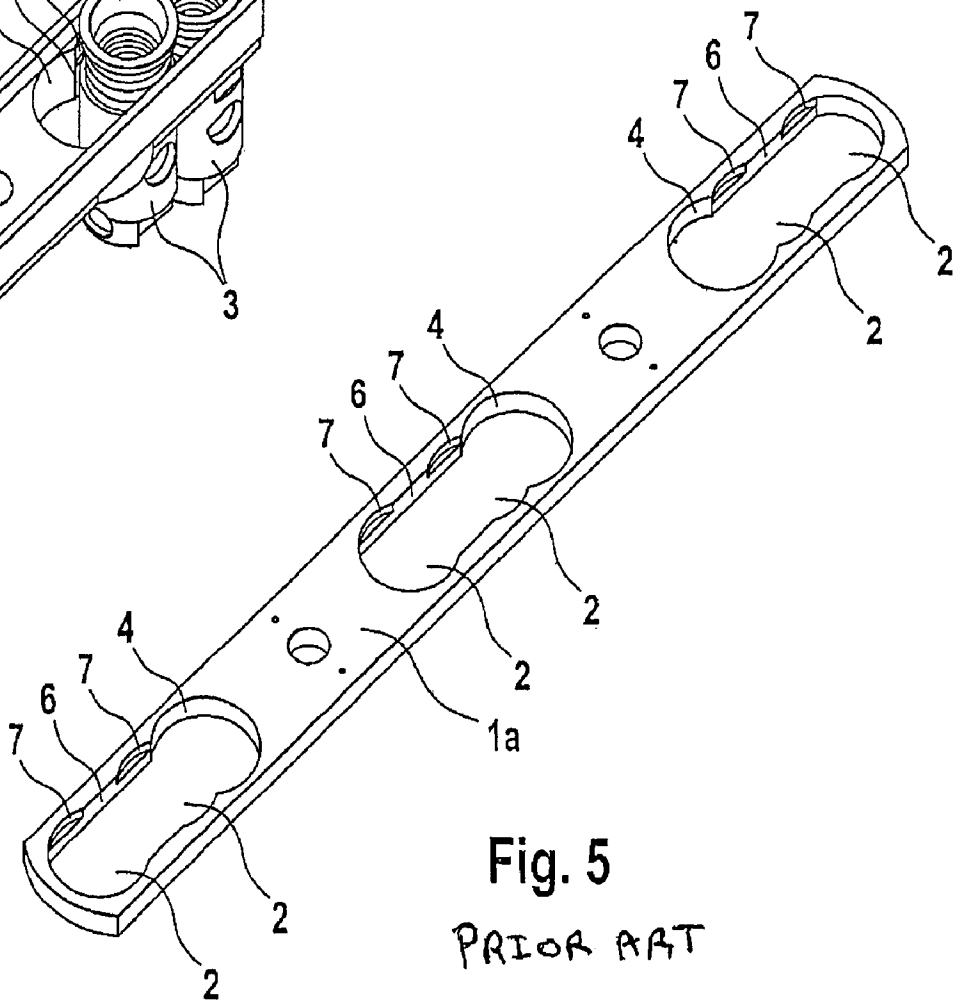
Fig. 5 PRIOR ART
FIG. 5 shows a perspective view of a guide gib according to the previously known prior art consisting entirely of a metallic material.

FIG. 5 illustrates a previously known guide gib 1*a* which is a metal punched part and can be produced in a simple way from a material strip. It is of a similar design to the guide gib 1 from FIG. 4, with the insertion bores 4, the holding spaces 2, the flattened portions 6 and the cut-outs 7. When using a material strip, the overall height of the guide gib 1*a* can be reduced to approximately 2 to 3 mm.

Figure 1:
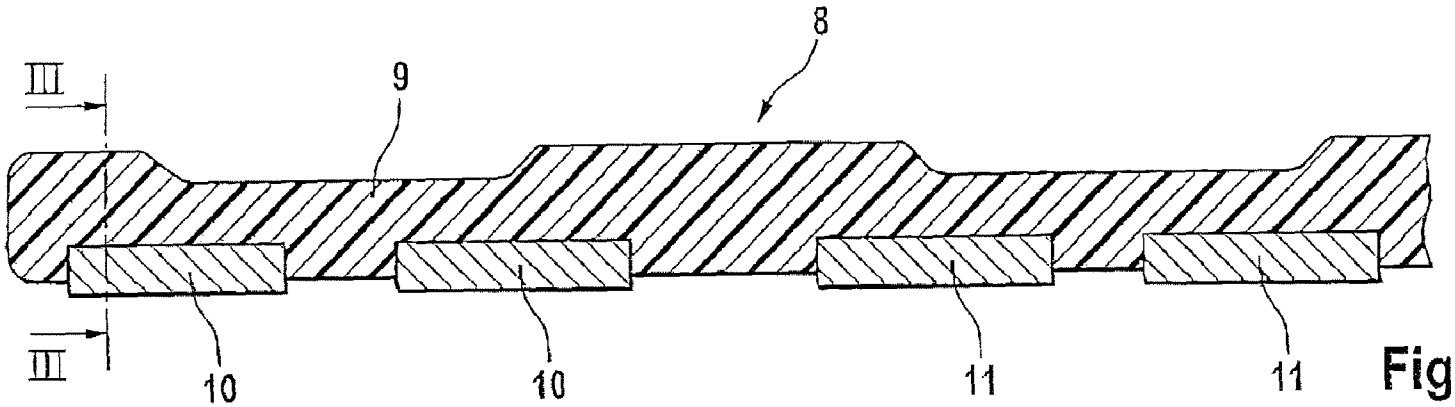
FIG. 1 shows a guide gib according to the invention in a vertical longitudinal section.
Figure 2:
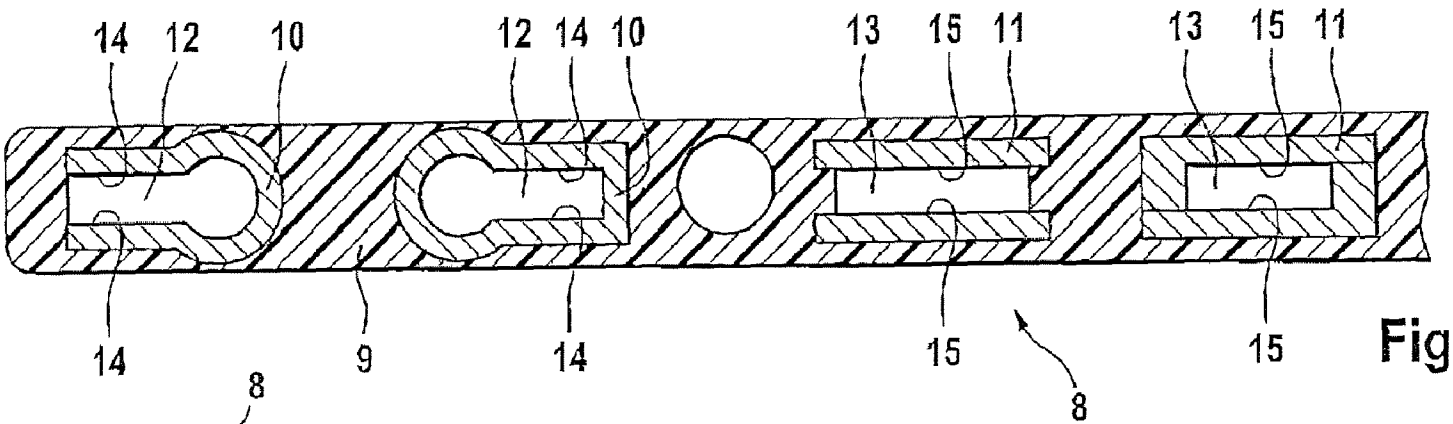
FIG. 2 shows the guide gib in a horizontal longitudinal section.
Figure 3:
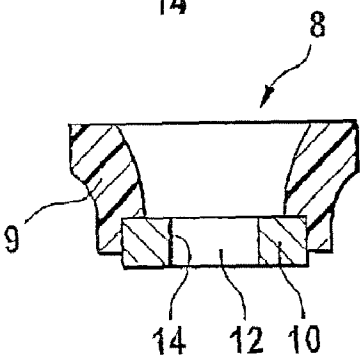
FIG. 3 shows the guide gib in a cross section as per line III-III in FIG. 1.

A guide gib 8 according to the invention, illustrated in FIGS. 1 to 3, consists of an elongated plastic support 9, in which are inserted four inlay parts 10 and 11 which are made from a higher-strength material than the material of the plastic support 9. The inlay parts 10 and 11 are arranged in the plastic support 9 in a row at intervals one behind the other. Each insert part 10 and 11 has a respective holding space 12 and 13 for a valve tappet. The inner surfaces of the inlay parts 10 are formed partially as flattened portions 14 which extend in perpendicular planes. Corresponding flattened portions 15 are situated on the inner surfaces of the inlay parts 11. The flattened portions 14 and 15 are provided for bearing against planar flattened portions of the inserted valve tappet, in order to hold the tappet in the guide gib 8 and to prevent the tappet from rotating about its longitudinal axis.

LIST OF REFERENCE SYMBOLS

1 Guide gib
1*a* Guide gib
2 Holding space
3 Valve tappet
4 Insertion bore
5 Trumpet-shaped end
6 Flattened portion
7 Cut-out
8 Guide gib
9 Plastic support
10 Inlay part
11 Inlay part
12 Holding space
13 Holding space
14 Flattened portion
15 Flattened portion

The invention claimed is:

1. A guide gib for use with an internal combustion engine for preventing rotation of a valve tappet, with flattened portions, about a central longitudinal axis of the valve tappet, the guide gib comprising:

an elongated plastic support having a longitudinal wall with a plurality of elongated openings through the wall, the openings arranged at intervals one behind the other for passage of the valve tappet through the openings;

an elongated metallic inlayed part mounted in each of the openings, the elongated metallic inlayed part having two elongated flattened portions positioned longitudinally in each of the openings for bearing against the flattened portions of the valve tappet thereby preventing the valve tappet from rotating about the central longitudinal axis of the valve tappet.

2. The guide gib of claim 1, wherein the elongated metallic inlayed part comprises two L-shaped pieces and the long leg of each of the L-shaped pieces providing one of the two flattened portions of the inlayed part.

3. The guide gib of claim 1, wherein the elongated metallic inlayed part comprises a U-shaped piece and the two long legs of the U-shaped piece provides the two flattened portions of the inlayed part.

4. The guide gib of claim 1, wherein the elongated metallic inlayed part comprises two bars and each bar provides one of the two flattened portions of the inlayed part.

* * * * *